US006703991B2

(12) United States Patent
Salters et al.

(10) Patent No.: US 6,703,991 B2
(45) Date of Patent: Mar. 9, 2004

(54) METHOD OF AND UNIT FOR DISPLAYING AN IMAGE IN SUB-FIELDS

(75) Inventors: Bart Andre Salters, Eindhoven (NL); Roy Van Dijk, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 289 days.

(21) Appl. No.: 09/817,979

(22) Filed: Mar. 27, 2001

(65) Prior Publication Data

US 2001/0040436 A1 Nov. 15, 2001

Related U.S. Application Data

(63) Continuation-in-part of application No. 09/741,976, filed on Dec. 20, 2000.

(30) Foreign Application Priority Data

Mar. 31, 2000 (EP) ..... 00201181

(51) Int. Cl.[7] ..... G09G 3/28
(52) U.S. Cl. ..... 345/63; 345/60; 345/690
(58) Field of Search ..... 345/60–70, 596, 345/597, 600, 690–693, 204; 315/169.1–169.4

(56) References Cited

U.S. PATENT DOCUMENTS 5,757,343 A * 5/1998 Nagakubo ..... 345/63
6,014,258 A * 1/2000 Naka et al. ..... 345/112
6,208,467 B1 3/2001 Naka et al. ..... 359/618
6,249,265 B1 * 6/2001 Tajima et al. ..... 345/63
6,297,788 B1 * 10/2001 Shigeta et al. ..... 345/63
6,373,452 B1 * 4/2002 Ishii et al. ..... 345/67
6,518,977 B1 2/2003 Naka et al. ..... 345/690
6,525,702 B1 * 2/2003 Van Dijk ..... 345/63

FOREIGN PATENT DOCUMENTS

EP 0896317 2/1999 ..... G09G/3/28

* cited by examiner

*Primary Examiner*—Lun-Yi Lao

(57) ABSTRACT

A display device (406) is driven in a number of sub-fields. Each of the sub-fields is for outputting a respective illumination level by the display device. In each sub-field, a pixel of the displayed image may emit an amount of light corresponding to the particular sub-field, depending on whether it is switched on or not. A required intensity level of the pixel is realized by selecting an appropriate combination of sub-fields in which the pixel is switched on. The number and relative weights of the available sub-fields are such that an intensity level can be realized in more than one way. In the display unit (300) for driving the device, the sub-pixels of a pixel are separately controlled regarding the choice as how the required intensity level is to be realized. The combinations of sub-fields for the respective sub-pixels are selected such that the sub-pixels have their subjective peak in luminance at different instants in the field period, thus reducing the flicker of the display.

11 Claims, 2 Drawing Sheets

METHOD OF AND UNIT FOR DISPLAYING AN IMAGE IN SUB-FIELDS

This is a continuation-in-part of application Ser. No. 09/741,976, filed Dec. 20, 2000.

BACKGROUND OF THE INVENTION

1. Field of the Invention

The invention relates to an image display unit for displaying an image on a display device in a plurality of sub-fields, wherein the display device is capable of generating, in each of the sub-fields, a respective illumination level, the image display unit comprising selection means for selecting a first combination of sub-fields for displaying a first color sub-pixel of a particular pixel with a first intensity level, and for selecting a second combination of sub-fields for displaying a second color sub-pixel of the particular pixel with a second intensity level.

The invention further relates to an image display apparatus comprising such an image display unit.

The invention also relates to a method of displaying an image on a display device in a plurality of sub-fields, whereby the display device is capable of generating, in each of the sub-fields, a respective illumination level, the method comprising a step of selecting a first combination of sub-fields for displaying a first color sub-pixel of a particular pixel with a first intensity level, and of selecting a second combination of sub-fields for displaying a second color sub-pixel of the particular pixel with a second intensity level.

2. Description of the Related Art

European Patent Application EP 0 896 317 A2, corresponding to U.S. Pat. Nos. 6,014,258, 6,208,467 and 6,518,977, describes a plasma display panel driven in a plurality of sub-fields. A plasma display panel is made up of a large number of cells that can be switched on and switched off. In the operation of the plasma display panel, three phases can be distinguished. The first phase is the erasure phase, in which the memories of all cells of the panel are erased. The second phase is the addressing phase, in which the cells of the panel that are to be switched on are conditioned by setting appropriate voltages on their electrodes. The third phase is the sustain phase, in which sustain pulses are applied to the cells which cause the addressed cells to emit light for the duration of the sustain phase. The plasma display panel emits light during this sustain phase. The three phases together are called a sub-field period or simply a sub-field. A single image, or frame, is displayed on the panel in a number of successive sub-field periods. A cell may be switched on for zero, one or more of the sub-field periods. The light emitted by a cell in the sub-field periods in which it is switched on, is integrated in the eye of the viewer. In a particular sub-field period, the sustain phase is maintained for a particular time resulting in a particular illumination level of the activated cells. Different sub-fields may have a mutually different or equal duration of their sustain phase. A sub-field is given a coefficient of weight to express its contribution to the light emitted by the panel during the whole frame period. An example is a plasma display panel with 6 sub-fields having coefficients of weight of 1, 2, 4, 8, 16 and 32, respectively. This is a so-called binary distribution. By selecting the appropriate sub-fields in which a cell is switched on, 64 different intensity levels can be realized in displaying an image on this panel. The plasma display panel is then driven by using code words of 6 bits each, whereby a code word indicates, in binary form, which sub-fields are to be switched on, i.e., what the intensity level of a pixel is.

The device described in EP 0 896 317 A2 uses a non-binary distribution of the sub-fields weights. Compared with the binary distribution, the relatively high valued sub-fields of the binary distribution have been split into two lower valued sub-fields. This is at the cost of a reduced number of intensity levels that can be realized with a given number of sub-fields, or at the cost of an increased number of sub-fields for realizing a given number of intensity levels. In the known device, almost every intensity level can be realized by a combination of a high and a low sub-field. In this way, a continuous gradation can be represented with a reduction of false contour interference. In a particular embodiment, the device has two tables, each one of which indicates, for each possible intensity level, the combination of sub-fields realizing that intensity level. For a number of intensity levels, the combination indicated in the one table for a specific intensity level is different from the combination indicated in the other table for that specific intensity level. It is proposed to apply a checkerboard pattern to the image and to use, for a pixel from a white block of the pattern, the combinations from the first table, and for a pixel from a black block of the pattern, the combinations from the second table. This results in a further reduction of false contours.

SUMMARY OF THE INVENTION

It is at object of the invention to provide an image display unit as described in the preamble, with a reduction of flicker. This object is achieved, according to the invention, in a display unit that is characterized in that the selection means is arranged to select that combination as second combination in which the subjective peak in luminance is at a different time position in the frame period compared with the subjective peak in luminance in the first combination. By controlling that the luminance peak from one color sub-pixel falls at a different moment than the luminance peak from the other color sub-pixel, the frequency component of the pixel signal having the frame frequency, usually 50 Hz or 60 Hz, is reduced. By a proper selection of the combination of sub-fields, the peak generated for one color sub-pixel is compensated by a peak in the other color sub-pixel. This is because the two sub-pixels are close together and that, as a consequence thereof, they are perceived as a single light source. It has appeared that when one color is generated at one instant in the frame period and the other color at a later instant in the frame period, the color perception remains unaffected compared with the simultaneous generation of the colors. Hence, one sub-pixel is lit early in the frame period and the other sub-pixel is lit later in the frame period, while the pixel as a whole is still perceived in the desired color. Applicants have realized that it is possible to use this freedom regarding the time of color generation for reducing flicker of the display. In practice, many color intensities will be generated by more than one sub-field, causing that the color will be generated at more than one instant. However, the distribution and weights of the sub-fields are such that there will be a subjective luminance peak in displaying such an intensity, e.g., when the highest sub-field is lit, and the instant of this peak will be perceived as the instant at which the color is generated. The latter is in respect to the perception of flicker and not to the perception of color, since, as described above, the time differences are such that the correct color is perceived.

The known device discloses the possibility of having two tables of different combinations of sub-fields for generating the various intensities. However, the combinations of one table are used for one group of pixels and the combinations of the other table are used for another group of pixels. It is to be noted that for an entire single pixel, always combinations from one of the two tables are used for each of its color sub-pixels. Thus, in the known device, a pixel is treated as one object, i.e., its sub-pixels are treated uniformly, regarding the selection of a combination of sub-fields. This contrasts the current invention, where the individual sub-pixels are individually controlled regarding the selection of sub-fields and the subsequent generation of light.

Furthermore, an embodiment of the known device has combinations of sub-fields that are designed in such a way that for many intensity levels, two emission peaks occur during the field period. This is realized by using a relatively large number of sub-fields and by appropriately positioning the multiple high sub-fields in the field period. The occurrence of two peaks in one frame period reduces the occurrence of flicker. In the present invention, a single combination of sub-fields typically has one peak and the other peak is generated by a second color sub-pixel receiving the appropriate sub-field combination with the peak at a different position. The solution of the known device is at the cost of a substantially reduced number of possible intensity levels in relation to the number of sub-fields. This is not attractive since such a large reduction of possible intensity levels seriously reduces the quality of the displayed image. The solution according to the invention results in combinations of sub-fields that can generate more intensity levels than the ones in the known device. This is caused by the fact that in the present invention, the occurrence and position of one peak per combination of sub-fields needs to be controlled, while in the known device, the occurrence and position of two peaks per combination need to be controlled. The latter gives a larger constraint when a combination is created from the available sub-fields, and thus requires a larger number of sub-fields to choose from. The invention provides a larger degree of freedom regarding the creation of combinations of sub-fields resulting in a more efficient use of the number of sub-fields, i.e., in more intensity levels for a given number of sub-fields.

An embodiment of the image display unit according to the invention is characterized in that the selection means is arranged to select, in the situation where the second intensity level is equal to the first intensity level, from the plurality of combinations that are able to realize the second intensity level different respective combinations for the first combination and the second combination. Only controlling the selection of the respective combinations for the first color sub-pixel and the second color sub-pixel in the case where the two sub-pixels have the same intensity, is a relatively easy task. This already leads to a reduction of the flicker in the displayed image.

An embodiment of the image display unit according to the invention further comprises storage means for storing a first set of combinations of sub-fields for realizing respective intensity levels, and for storing a second set of combinations of sub-fields for realizing the same respective intensity levels, wherein the selection means is arranged to select the first combination from the first set and the second combination from the second set. By having two sets of different combinations of sub-fields for generating the possible intensity levels, the selection means merely has to select the combination for the particular intensity level from the set corresponding with the color sub-pixel at hand. This highly reduces the computational effort required at real time, since the sets are created and stored in advance in the display unit.

An embodiment of the image display unit according to the invention is characterized in that a combination of the first set has a first subjective peak in luminance, and a combination of the second set has a second subjective peak in luminance, whereby the first and the second subjective peaks have a time difference of substantially a half frame period. Using the combination of the first set in one sub-pixel of a particular pixel and the combination of the second set in another sub-pixel of that particular pixel, results in the occurrence of two peaks in the frame period at a time difference of half the frame period. This is perceived as a doubling of the frame frequency, resulting in a reduction of the flicker. When this is applied for a frame frequency of 50 Hz, the perceived luminance frequency becomes 100 Hz which is higher than the human eye can see. Thus no flicker will be seen for this particular pixel.

An embodiment of the image display unit according to the invention is characterized in that for realizing a particular intensity level the second combination for realizing this particular level is chosen to be different from the first combination for realizing this particular level. It is relatively easy to generate the two sets wherein the respective combinations for a particular intensity level are different. Using these two sets already results in a reduction of the flicker in displaying the image.

An embodiment of the image display unit according to the invention is characterized in that the combinations of sub-fields for realizing the particular intensity level have been chosen for the first and the second set according to the steps generating a set of candidate combinations of sub-fields, each of which being able to realize the particular intensity level, making a frequency analysis for each pair of the candidate combinations and determine a respective value for respective components having the frame frequency, determining which pair has the smallest value for the component having the frame frequency, and incorporating the candidate combinations of this pair in the first set and the second set, respectively. By analyzing to what extent a pair of combinations to be applied to the first color sub-pixel and the second color sub-pixel comprises a frequency component of the frame frequency, the optimal respective combinations for a particular intensity level are put into the first set and the second set.

An embodiment of the image display unit according to the invention is characterized in that a pixel comprises a green sub-pixel, a red sub-pixel and a blue sub-pixel and wherein the selection means is arranged to select the first combination for the green sub-pixel and the second combination for the red sub-pixel and for the blue sub-pixel. Since a green sub-pixel of a certain luminance contributes to about half the perceived pixel luminance and the red and blue sub-pixels of the same certain luminance together contribute to about the other half of the perceived pixel luminance, flicker is considerably reduced by supplying the first combination to the green sub-pixel and the second combination to the red and the blue sub-pixels.

An embodiment of the image display unit according to the invention is characterized in that the selection means is arranged to select a combination of sub-fields for a neighboring pixel of the particular pixel in dependence on the selection for the particular pixel, whereby for a color sub-pixel of the neighboring pixel corresponding with the first color sub-pixel of the particular pixel, the second combination is selected, and for a color sub-pixel of the neighboring pixel corresponding with the second color sub-pixel of the particular pixel, the first combination is selected. In particular, in the case where an area of the image has a color that is the same as or similar to one of the primary colors, i.e., the color of the sub-pixels, the intensity of one of the sub-pixels will be far larger than the intensity of the others.

Then it is not very well possible to compensate the peak generated by one sub-pixel with a peak generated by another sub-pixel according to the invention. By reversing the allocation of combinations in a neighboring pixel, also in this case flicker is reduced since the peak of a certain sub-pixel is now compensated by a peak of the corresponding sub-pixel in the neighboring pixel. This technique can easily be used in the embodiments having respective sets for the first color sub-pixel and the second color sub pixel. Then, in a particular pixel, the first set is used for the green sub-pixel and the second set for the red and blue sub-pixels, while in the neighboring pixel of the particular pixel, the first set is used for the red and blue sub-pixels and the second set for the green sub-pixel. This technique can be implemented by applying a checkerboard pattern to the pixels. Pixels corresponding to white fields are identified as neighbors of pixels corresponding to black fields. Furthermore, the technique can be implemented on a line-by-line or on a column-by-column basis. The pixels of one line (or column) are treated in one way regarding the above selection, while the pixels of the neighboring line (or column) are treated in the second way.

It is a further object of the invention to provide a method as described in the preamble with a reduction of flicker. This object is achieved, according to the invention, in a method that is characterized in that from a plurality of combinations that are able to realize the second intensity level, that combination is selected as second combination in which the subjective peak in luminance is at a different time position in the frame period compared with the subjective peak in luminance in the first combination.

BRIEF DESCRIPTION OF THE DRAWINGS

The invention and its attendant advantages will be further elucidated with the aid of exemplary embodiments and the accompanying schematic drawings, in which.

Corresponding features in the various Figures are denoted by the same reference symbols.

DESCRIPTION OF THE PREFERRED EMBODIMENTS

Figure 1:
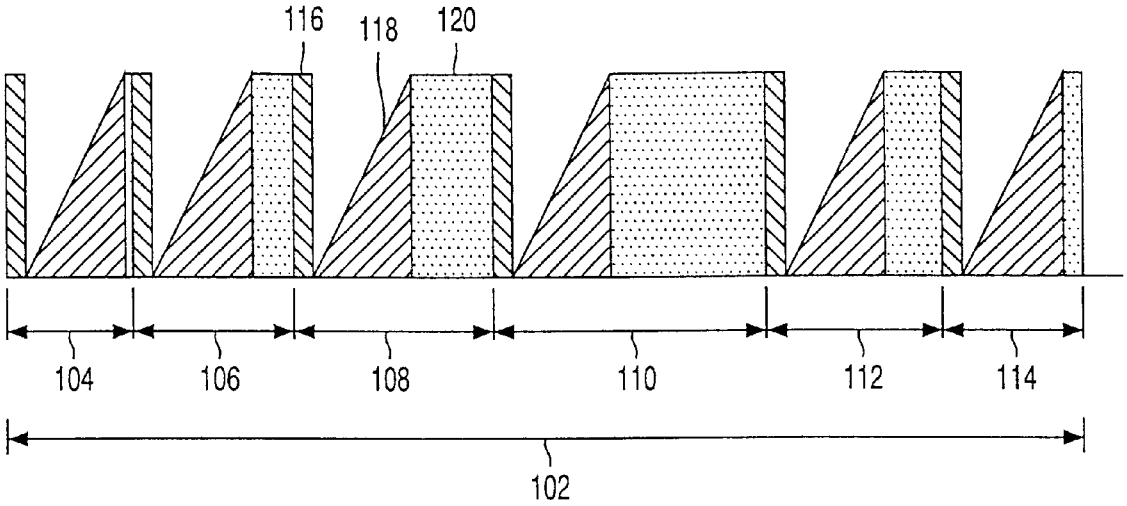
FIG. 1 schematically shows a field period with 6 sub-fields.

FIG. 1 schematically shows a field period with 6 sub-fields. The field period 102, also called the frame period, is the period in which a single image or frame is displayed on the display panel. In this example, the field period 102 consists of 6 sub-fields indicated with references 104, 106, 108, 110, 112 and 114. In a sub-field, a cell of the display panel may be switched on in order to produce an amount of light. Each sub-field starts with an erasure phase, in which the memories of all cells are simultaneously erased. The next phase in the sub-field is the addressing phase, in which the cells that are to be switched on for emitting light in this particular sub-field are conditioned. Then, in a third phase of the sub-field, which is called the sustain phase, sustain pulses are applied to the cells. This causes the cells that have been addressed to emit light during the sustain phase. The organization of these phases is shown in FIG. 1, where time runs from left to right. For example, sub-field 108 has an erasure phase 116, an addressing phase 118 and a sustain phase 120. It is to be noted that in some panels, the sub-field ends with the erasure phase, rather than starting with it. However, this is of no significance to the invention which can be applied in either case.

The perceived intensity of a pixel of a displayed image is determined by controlling during which of the sub-fields of the cell corresponding to the pixel are switched on. The light emitted during the various sub-fields in which a cell is switched on is integrated in the eyes of the viewer, thus resulting in a certain intensity of the corresponding pixel. A sub-field has a coefficient of weight indicating its relative contribution to the emitted light. An example is a plasma display panel with 6 sub-fields having coefficients of weight of 1, 2, 4, 8, 16 and 32, respectively. By selecting the appropriate combination of sub-fields in which a cell is switched on, 64 different intensity levels can be realized in displaying an image on this panel. The plasma display panel is then driven by using binary code words of 6 bits each, whereby a code word indicates the intensity level of a pixel in binary form.

Figure 2:
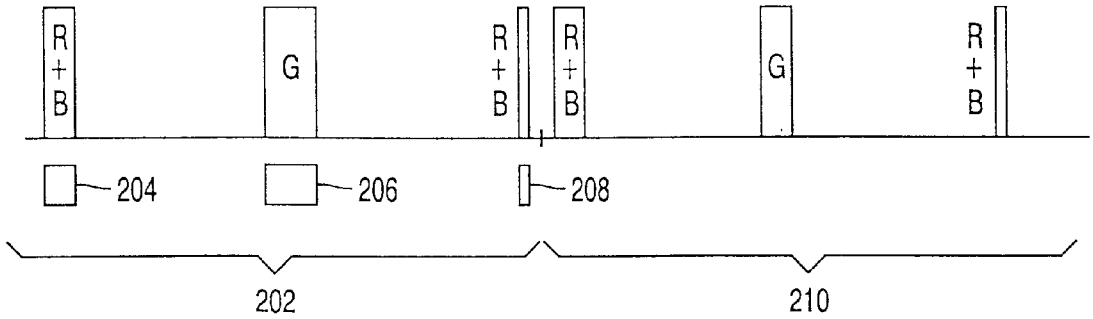
FIG. 2 shows the principle of the invention.

FIG. 2 shows the principle of the invention. A pixel of the plasma display panel is made out of three sub-pixels, namely, a green sub-pixel, a red sub-pixel and a blue sub-pixel. Assume, for this example, that the sub-field distribution of the panel is such that the intensity value '20' can be generated by two different combinations of sub-fields: by a first combination containing a sub-field with the value '20' and by a second combination containing a sub-field with the value '16' and a sub-field with the value '4'. The field period 202, also called frame period, is made up of a number of sub-fields. Shown are sub-field 204 with value '16' at the beginning of the field period, sub-field 206 with value '20' midway the field period, and sub-field 208 with value '4' at the end of the field period. A white pixel with intensity level '20' is now made in the following way. The light for the green sub-pixel is realized by using the first combination, thus by lighting sub-field 206. The light for the red sub-pixel and for the blue sub-pixel is realized by the second combination, thus by lighting sub-field 204 and sub-field 208. Looking at the timing of light production, in a short period, at the beginning of the field period, light is produced by the red sub-pixel and by the blue sub-pixel each with a relative intensity of '16'. Then midway the field period, light is produced by the green sub-pixel with a relative intensity of '20'. Finally, at the end of the field period, light is produced by the red sub-pixel and the blue sub-pixel each with a relative intensity of '4'. Then the process is repeated for the second field period 210. Due to the fact that the sub-pixels are close together, the light productions appear to originate from a single source. Furthermore, the nature of the sub-pixels is such that separate light productions result in separate flashes of light, whereby two light productions immediately following each may be perceived together. The color green contributes approximately twice as much to the luminance as the colors red and blue. This means that the simultaneously produced flashes for red and blue of value '16', potentially together with the nearby flashes of value '4' are perceived as being of the same intensity as the intensity of the green flash of value '20'. This means that the user perceives one flash at the beginning of the field period 202 and one flash midway the field period 202, and then again a flash at the beginning of the second field period 210, etc. Thus, the user sees flashes at a frequency which is twice as large as the frequency of displaying the images. This means that if the images are produced at 50 Hz or 60 Hz, the light is now produced at a frequency of 100 Hz or 120 Hz. This is higher than a human eye can perceive and, therefore, the flicker has been removed in this situation.

An embodiment of the invention has two sets specifying how the different intensity levels are to be realized. A set contains, for each possible intensity level, a combination of sub-fields. The selection means for selecting a combination of sub-fields according to the invention is now very simple, since it only must retrieve the combination from the appropriate table. The two sets are called A and B, respectively, and parts of them are shown in the table below. In this embodiment, 128 different intensity levels can be realized, but for the sake of brevity, not all these levels have been shown.

the field period. Furthermore, the combinations for different intensity levels are entered in a table in a way that in one table, the peaks of different combinations are consistent in position, if possible. For example, in the range 23 to 44, table A whereas table B contains the combinations where the second occurrence of sub-field '15' is used. This makes the tables more robust in that also different intensities for the color sub-pixels still have compensating peaks. In this embodiment, the second sub-field with value '15' lies midway the field period because the length of the sustain phase of a sub-field is proportional to the weight of that sub-field. Thus a sub-field with a smaller weight is shorter in time than a sub-field with a larger weight. Furthermore, the addressing

| Weight | A | | | | | | | | B | | | | | | | |
|---|---|---|---|---|---|---|---|---|---|---|---|---|---|---|---|---|
| level | 15 | 40 | 2 | 4 | 1 | 15 | 43 | 7 | 15 | 40 | 2 | 4 | 1 | 15 | 43 | 7 |
| 1 | | | | | X | | | | | | | | X | | | |
| 2 | | | X | | | | | | | | X | | | | | |
| 3 | | | X | | X | | | | | | X | | X | | | |
| 4 | | | | X | | | | | | | | X | | | | |
| 5 | | | | X | X | | | | | | | X | X | | | |
| 6 | | | X | X | | | | | | | X | X | | | | |
| 7 | | | X | X | X | | | | | | | | | | | X |
| 8 | | | | | X | | | X | | | | | X | | | X |
| 12 | | | | X | X | | | X | | | | X | X | | | X |
| 15 | X | | | | | | | | | | | | | X | | |
| 16 | X | | | | X | | | | | | | | X | X | | |
| 23 | X | | | | X | | | X | | | | | X | X | | X |
| 30 | X | | | | | X | | | X | | | | | X | | |
| 42 | X | | | X | X | X | | X | X | | | X | X | X | | X |
| 43 | X | | X | X | | X | | X | X | | X | X | | X | | X |
| 44 | X | | X | X | X | X | | X | X | | X | X | X | X | | X |
| 45 | | X | | X | X | | | | | | X | | | | X | |
| 46 | | X | X | X | | | | | | | X | | X | | X | |
| 47 | | X | | | | | | X | | | | X | | | X | |
| 50 | | X | X | | X | | | X | | | | | | | X | X |
| 55 | X | X | | | | | | | | | | X | X | | X | X |
| 82 | X | X | | X | X | X | | X | X | | X | | | X | X | X |
| 83 | | X | | | | | X | | X | | X | | X | X | X | X |
| 109 | | X | | X | | X | X | X | X | X | | X | | | X | X |
| 126 | X | X | X | X | | X | X | X | X | X | X | X | | X | X | X |
| 127 | X | X | X | X | X | X | X | X | X | X | X | X | X | X | X | X |

There are 8 sub-fields with relative weights as indicated in the table. The instant of activation of the sub-fields in the frame period is in the order as indicated in the table. The number of sub-fields and their relative weights are such that many intensity levels can be realized in more than one way. The sets have been designed to exploit this possibility and to define, for a given intensity level, two combinations that are suitable for mutual compensation as described above in connection with FIG. 2. Therefore, a combination from one set is applied to the green sub-pixel and a combination from the other set to the red and blue sub-pixels. When defining the sets, for a given intensity level, first it is determined what combinations are possible to realize this intensity level. Then it is analyzed which two of the combinations can best be chosen in that the two together have the smallest 50 Hz signal component. In this embodiment, the fields are displayed at 50 Hz and, therefore, the 50 Hz component should be reduced as much as possible in order to reduce the perceived flicker. One of the two chosen combinations is then entered in set A and the other in set B. For example, level '16' in set A is realized by the first sub-field with value '15' plus the sub-field with value '1' and level '16' in set B is realized by the sub-field with value '1' plus the second sub-field with value '15', which lies approximately midway plus erasing phase of each sub-field takes 30 time units, a time unit being the same as the unit indicating the sub-field weight.

In the sets above, a combination of sub-fields for a particular intensity level in one set has been chosen so that it optimally matches the combination of sub-fields for that same level in the other set. An improved embodiment is to choose a combination of sub-fields for a particular intensity level in one table so that it optimally matches the average of all other combinations of sub-fields in the other table. In that way, an improvement is achieved since the combinations for the various levels in the two tables can be matched in a given pixel.

A further improvement is to exchange the choice from the sets for the respective sub-pixels for different pixels. Then, for a given pixel, the combination of sub-fields for the green sub-pixel is retrieved from set A while, for the neighboring pixel, the combination of sub-fields for the green sub-pixel is retrieved from set B. And in the same way, for that given pixel, the combination of sub-fields for the red and blue sub-pixels is retrieved from set B while, for the neighboring pixel, the combination of sub-fields for the red and blue sub-pixels is retrieved from set A. Using such a checkerboard refinement, the advantage of the invention is also realized for the display of an area in one of the primary colors, green, red or blue. In such a case, only the relevant color sub-pixel of a pixel emits light while the other two remain substantially dark. This means that the peak from the relevant color sub-pixel cannot be compensated by a peak from one of the other sub-pixels. In this embodiment, the peak from one sub-pixel of a pixel is compensated by a peak from the corresponding sub-pixel of the neighboring since that corresponding sub-pixel now receives the compensating combination of sub-fields.

A further improvement is to choose the particular combination of sub-fields for a color sub-pixel of a pixel in dependence on the actual intensity level of the other sub-pixels of that pixel and how these levels can be realized. This requires a real time analysis of the image and of the various possibilities available to realize the required pixel color. In this case, the choice for an actual combination of sub-fields for a given sub-pixel is no longer governed by the location of the sub-pixel, as is the case for the earlier techniques, but is governed by the actual content of the image.

An alternative to the choice of weights of sub-fields described above, is the following set of weights: 1, 1, 3, 3, 9, 9, 27, 27. This is called a ternary weight distribution, since the weights are powers of three. This set of sub-field weights has a property similar to the binary sub-fields weights in that each intermediate value can be realized with a proper combination of the sub-fields. For example, the level with intensity value 41 is realized by selecting the sub-fields with weights 27, 9, 3, 1 and 1. Another important property is that each sub-field weight is present twice. This property is exploited to reduce flicker. To this end, the sub-fields are arranged in the following order with respect to their weight: 1-3-9-27-1-3-9-27. This provide for 81 different intensity levels. Because the frame period consists of two equal parts, one can see it as two separate frames, displayed in the double frequency of the original frame, thus 100 Hz instead of 50 Hz, or 120 Hz instead of 60 Hz. A number of intensity levels, for the whole frame, use a sub-field of a particular weight of the first part and a sub-field of the same weight of the second part. These sub-fields are half a frame period apart, which results in a doubling of the frequency for the complete intensity level. Examples are intensity levels 2 (1+1), 6 (3+3), 8 (1+3+1+3), etc. In this way, for approximately a third of the available intensity levels, flicker is completely eliminated. The other intensity levels cannot be realized in this way, e.g., level 36 can only be realized by two sub-fields, namely, with weight 9 and 27, respectively. However, there is a freedom to choose the sub-fields from the first part or from the second part of the frame period. Now, this choice is made in a further embodiment of the invention using the above ternary distribution of sub-fields in the way described in connection with FIG. 2. For the green sub-pixels, certain sub-fields are selected from the first part and, if necessary, from the second part to realize the desired intensity level. For the blue and the red sub-pixels, the choice is mirrored: the sub-fields that had been chosen for the green sub-pixel from the first part are now selected from the second part and the sub-fields that had been chosen for the green sub-pixel from the second part are now selected from the first part. This makes that a sub-field of a green sub-pixel is compensated by a sub-field from the blue and red sub-pixels since they are exactly half the field period apart.

An advantageous selection for a color sub-pixel, e.g., the green sub-pixel, as such is to spread the sub-fields over the two parts as much as possible. Then there is already a compensating effect within a single color sub-pixel. For example, to make the intensity '36', sub-fields 27 and 9 are required. It is advantageous to choose sub-field 27 from one part, e.g., the first, and sub-field 9 from the other part, thus the second. This provides a compensating effect within the green sub-pixel giving a reduction of the 50/60 Hz component of the light and thus of the flicker. For intensity level '36' for the blue and the red sub-pixels in this example, sub-field 27 is selected from the second part and 9 from the first part, providing the effect described in connection with FIG. 2 for the remaining uncompensated light. The combination of a ternary sub-field distribution and a compensating choice for the green sub-pixel versus the blue and red sub-pixels when this is required, results in an improved reduction of flicker.

The order of the ternary sub-fields described above, i.e., the order 1-3-9-27-1-3-9-27, is not the only possibility. As long as there are two identical halves in a single frame period, the advantage of doubling of the perceived frequency is achieved. This means that for such a half frame period, any permutation of 1-3-9-27 is suitable, e.g., 3-27-1-9. This provides for 16 different choices, from which one can be chosen that is optimal in view of other criteria.

Furthermore, the embodiments described above with the ternary sub-field distribution can be further improved by alternating the choice for selection of sub-fields from the first part and the second part for neighboring pixels. This is analogous to the checkerboard refinement defined above for the choice from set A and set B. Applying the checkerboard works very well for the ternary distribution because the sub-fields of the first part have exactly the same weight as the sub-fields of the second part of the compensating neighboring pixel.

Figure 3:
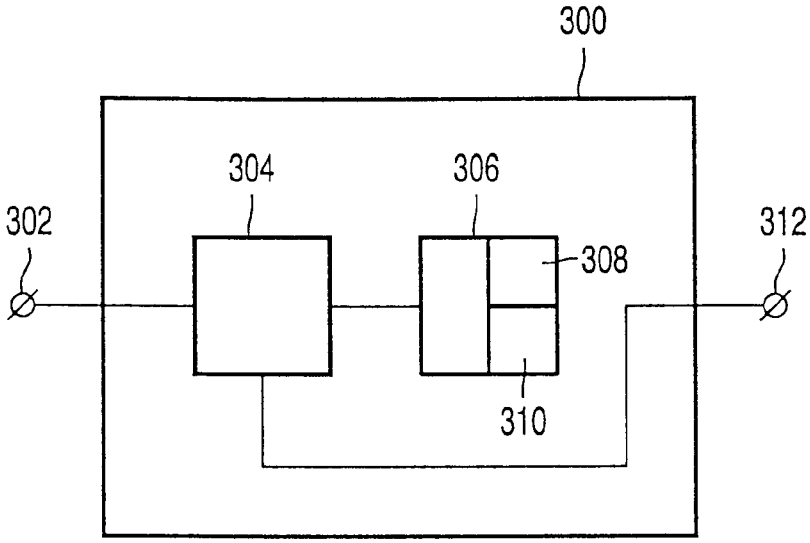
FIG. 3 schematically shows the main elements of a display unit according to the invention.

FIG. 3 schematically shows the main elements of a display unit according to the invention. The display unit 300 has an input 302 to receive a stream of pixels representing the image. The display unit has a selection module 304 that selects the combinations of sub-fields to be used for the sub-pixels of the particular pixel currently being processed. These combinations may be retrieved from a storage space 306. As described above, the device can include two sets of sub-fields, designated sets 308 and 310, containing the combinations of sub-fields to be used. Finally, the display unit has an output 312 for outputting the selected combinations to a subsequent device for controlling the actual activation of the various sub-fields.

Figure 4:
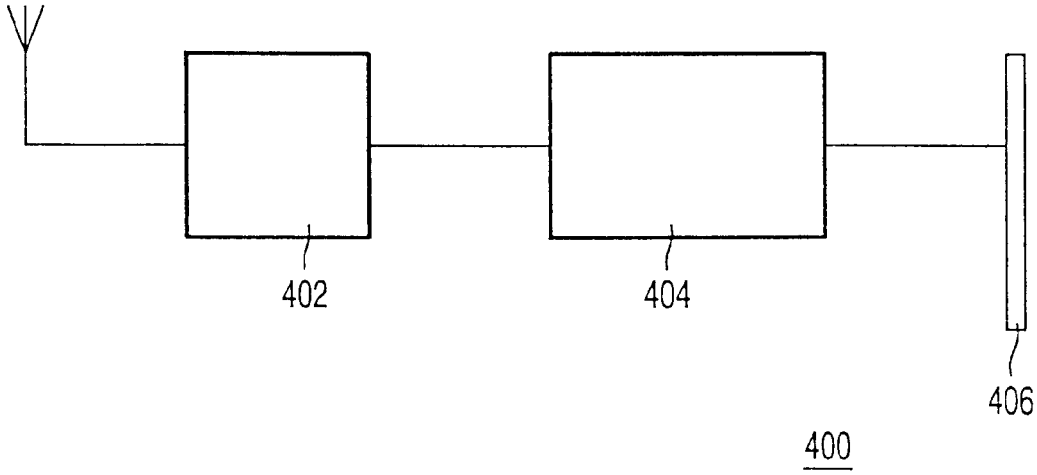
FIG. 4 shows the most important elements of an image display apparatus according to the invention.

FIG. 4 shows the most important elements of an image display apparatus according to the invention. The image display apparatus 400 has receiving means 402 for receiving a signal representing the image to be displayed. This signal may be a broadcast signal received via an antenna or cable, but may also be a signal from a storage device, like a VCR (Video Cassette Recorder). The image display apparatus 400 further has an image display unit 404 for processing the image and a display device 406 for displaying the processed image. The display device 406 is of a type that is driven in sub-fields. The image display unit is implemented as described in connection with FIG. 3.

It should be noted that the above-mentioned embodiments illustrate rather than limit the invention and that those skilled in the art will be able to design many alternative embodiments without departing from the scope of the appended claims. The word 'comprising' does not exclude the presence of elements or steps other than those listed in a claim. The word "a" or "an" preceding an element does not exclude the presence of a plurality of such elements. The invention can be implemented by means of hardware comprising several distinct elements and by means of a suitably programmed computer. In the unit claims enumerating several means, several of these means can be embodied by one and the same item of hardware.

What is claimed is:

1. An image display unit for displaying an image on a display device in a plurality of sub-fields collectively forming a frame, wherein the display device is capable of generating, in each of the sub-fields, a respective illumination level, the image display unit comprising selection means for selecting a first combination of sub-fields for displaying a first color sub-pixel of a particular pixel with a first intensity level and for selecting a second combination of sub-fields for displaying a second color sub-pixel of the particular pixel with a second intensity level, characterized, in that the selection means selects the second sub-field combination such that a subjective peak in luminance is at a different time position in a frame period compared with a subjective peak in luminance in the first sub-field combination.

2. The image display unit as claimed in claim 1, wherein the selection means selects, in the situation where the second intensity level is equal to the first intensity level, from a plurality of sub-field combinations that are able to realize the second intensity level, different respective combinations for the first sub-field combination and the second sub-field combination.

3. The image display unit as claimed in claim 1, comprising storage means for storing a first set of combinations of sub-fields for realizing respective intensity levels and for storing a second set of combinations of sub-fields for realizing the same respective intensity levels, wherein the selection means selects the first sub-field combination from the first set of combinations and the second sub-field combination from the second set of combinations.

4. The image display unit as claimed in claim 3, wherein a combination of the first set has a first subjective peak in luminance and a combination of the second set has a second subjective peak in luminance, whereby the first and the second subjective luminance peaks have a time difference of substantially a half frame period.

5. The image display unit as claimed in claim 3, wherein, for realizing a particular intensity level, the selection means selects the second sub-field combination for realizing the particular intensity level to be different from the first sub-field combination for realizing the particular intensity level.

6. The image display unit as claimed in claim 3, wherein the combinations of sub-fields for realizing the particular intensity level have been chosen for the first and the second set according to the following steps:

generating a set of candidate combinations of sub-fields, each of which being able to realize the particular intensity level;

making a frequency analysis for each pair of the candidate combinations and determining a respective value for respective components having the frame frequency;

determining which pair has the smallest value for the component having the frame frequency; and incorporating the candidate combinations of this pair in the first set and second set, respectively.

7. The image display unit as claimed in claim 1, wherein a pixel comprises a green sub-pixel, a red sub-pixel and a blue sub-pixel, and wherein the selection means selects the first sub-field combination for the green sub-pixel and the second sub-field combination for the red sub-pixel and for the blue sub-pixel collectively.

8. The image display unit as claimed in claim 1, wherein the selection means selects a combination of sub-fields for a neighboring pixel of the particular pixel in dependence on the selection for the particular pixel, whereby, for a color sub-pixel of the neighboring pixel corresponding with the first color sub-pixel of the particular pixel, the second combination is selected, and for a color sub-pixel of the neighboring pixel corresponding with the second color sub-pixel of the particular pixel, the first combination is selected.

9. The image display unit as claimed in claim 1, wherein the plurality of sub-fields is arranged according to a ternary distribution, in which relative weights of the sub-fields are based on the number three.

10. An image display apparatus for displaying an image, comprising:

receiving means for receiving a signal representing the image;

the image display unit as claimed in any one of the claims 1 to 8; and a display device for displaying the image.

11. A method of displaying an image on a display device in a plurality of sub-fields collectively forming a frame, whereby the display device is capable of generating, in each of the sub-fields, a respective illumination level, the method comprising the steps:

selecting a first combination of sub-fields for displaying a first color sub-pixel of a particular pixel with a first intensity level; and selecting a second combination of sub-fields for displaying a second color sub-pixel of the particular pixel with a second intensity level, characterized in that, from a plurality of combinations that are able to realize the second intensity level, the second sub-field combination is selected such that a subjective peak in luminance is at a different time position in a frame period compared with a subjective peak in luminance in the first sub-field combination.

* * * * *